United States Patent [19]

Krautz

[11] Patent Number: 5,038,540

[45] Date of Patent: Aug. 13, 1991

[54] SECTIONAL SMOKESTACK

[76] Inventor: Alfons O. Krautz, 57 North Country Rd., Shoreham, N.Y. 11786

[21] Appl. No.: 440,460

[22] Filed: Nov. 20, 1989

Related U.S. Application Data

[63] Continuation-in-part of Ser. No. 803,387, Nov. 29, 1985, abandoned, which is a continuation of Ser. No. 323,257, Nov. 20, 1981, abandoned.

[51] Int. Cl.[5] ..... E04B 1/32

[52] U.S. Cl. ..... 52/245; 52/248; 52/432; 52/583; 52/587

[58] Field of Search ..... 52/245, 248, 249, 432, 52/583, 587, 236.8, 219, 262, 218

[56] References Cited

U.S. PATENT DOCUMENTS

| | | | |
|---|---|---|---|
| 1,094,080 | 4/1914 | Mayer | 52/193 |
| 1,194,305 | 8/1916 | McMillan | 52/245 |
| 2,038,615 | 4/1936 | Underdown | 52/587 |
| 2,160,773 | 5/1939 | Wolfe | 52/587 |
| 2,229,779 | 1/1941 | Thomas | 52/583 |
| 2,810,287 | 10/1957 | Anderson | 52/432 |
| 2,851,873 | 9/1958 | Wheeler-Nicholson | 52/262 |
| 4,104,868 | 8/1978 | Jackson | 52/743 |
| 4,147,009 | 4/1979 | Watry | 52/744 |
| 4,461,130 | 7/1984 | Shubow | 52/236.8 |

FOREIGN PATENT DOCUMENTS

| | | | |
|---|---|---|---|
| 104867 | 9/1938 | Australia | 52/583 |
| 2311183 | 9/1974 | Fed. Rep. of Germany | 52/245 |
| 2508470 | 4/1976 | Fed. Rep. of Germany | 52/248 |
| 676712 | 2/1930 | France | 52/245 |
| 1145789 | 10/1957 | France | 52/245 |

OTHER PUBLICATIONS

Random House, The Random House College Dictionary, First Edition, p. 62, "aperature".

*Primary Examiner*—Richard E. Chilcot, Jr.
*Attorney, Agent, or Firm*—Richard C. Conover

[57] ABSTRACT

A sectional smokestack wherein each section is assembled from multiple precast concrete segments having aligned vertical ribs. The sections are stacked axially one upon the other during erection of the smokestack. Concentrated reinforcement extends vertically through aligned apertures in each rib from the bottom of the smokestack to the top of the smokestack. Each of the segments which are used to assemble a section have structural tie rods which extend laterally within a segment and extend into the aperture on opposite sides of the concentrated reinforcement to transfer wind loads and heat stress loads to the concentrated reinforcement.

8 Claims, 5 Drawing Sheets

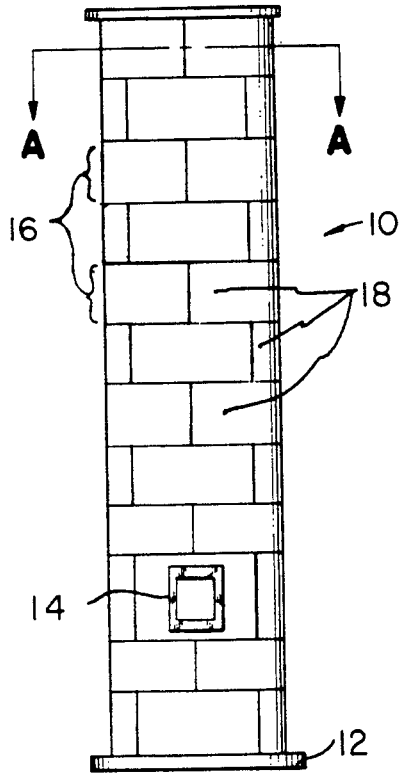
FIG. 1
FIG. 2
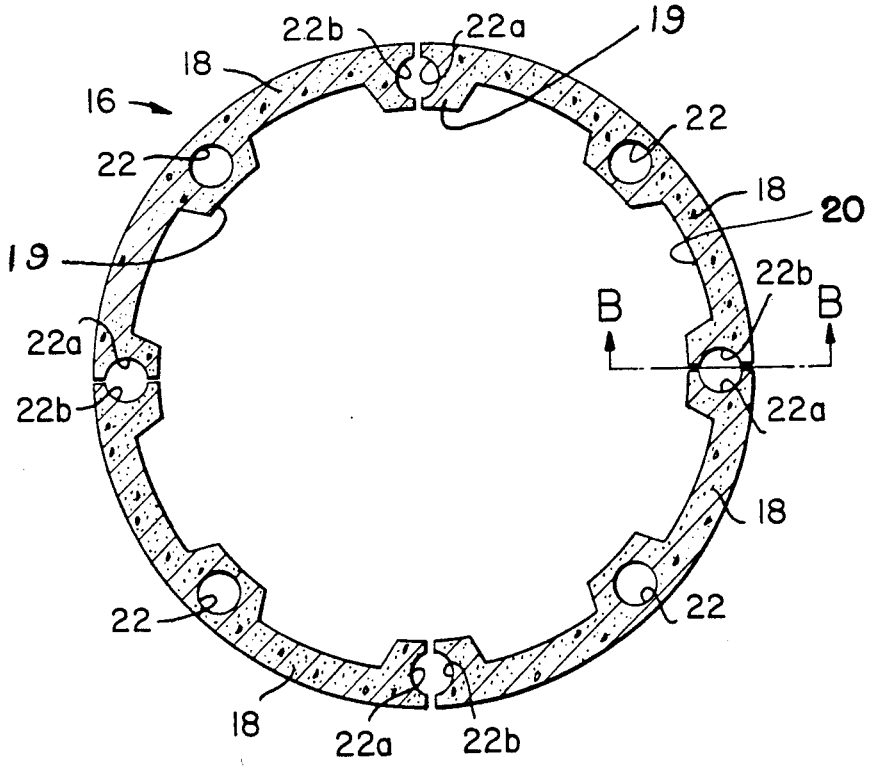

SECTIONAL SMOKESTACK

This application is a continuation-in-part of application Ser. No. 803,387, filed Nov. 29, 1985, which is a continuation of application Ser. No. 323,257 filed Nov. 20, 1981 now abandoned.

BACKGROUND OF THE INVENTION

This invention relates in general to a precast concrete smokestack constructed by stacking sections axially one upon the other. In particular this invention relates to a sectional smokestack where each of the sections is assembled at the job site from multiple segments and further relates to the structure for tying these segments together to form an integral section.

Masonry stacks are well known where materials such as bricks are stacked and secured to one another with mortar. Concrete stacks are also known where the smokestack is constructed at the job site either by pouring the concrete stack directly or by constructing the stack with precast concrete sections.

For example, U.S. Pat. No. 4,104,868 describes a sectionalized precast concrete smokestack. This patent describes a method of contructing a chimney by stacking interfitting one-piece segments vertically to form an inner liner of a dual wall smokestack and then constructing an outer wall spaced from the inner liner by stacking interfitting one-piece segments vertically and in surrounding relation to the inner liner. Reinforcing steel bars are placed in the interstitial gap between the inner liner and the outer wall during construction of the stack and concrete is poured in situ into the gap to cement the adjacent segments together and to cement the inner wall to the outer wall. The outer wall includes circumferential reinforcing steel hoops to permit the outer wall to contain hoop stresses.

In these prior art concrete stacks constructed such as shown in U.S. Pat. No. 4,104,868 there is a practical limitation on the circumferential size of the stack to be constructed because of the limitations on the size of the inner liner one-piece segments and the outer wall one-piece segments. As the diameter of the stack becomes larger these segments become more unwieldy. Further, with only reinforcing hoops in the outer wall and no reinforcing rods in the inner liner there is a greater possibility of breakage or cracking of the segments during assembly.

SUMMARY OF INVENTION

The present invention overcomes the disadvantages of prior precast sectionalized smokestacks by having each section divided into multiple precast segments. The precast segments are assembled into sections at the job site. At the time of casting these segments temperature rebar is embedded therein to increase the strength of each segment. Further, structural tie rods, are embedded in the segment at the time of casting. These structural tie rods which extend outwardly from each segment, are used to tie adjoining segments together to form an integral section and to tie these segments to vertical reinforcing rods which extend from the bottom of the the stack to the top of the stack. These reinforcing rods are used to tie adjacent vertical sections together and to enable the stack to withstand high wind loads under operating conditions. With this invention a smokestack can be assembled quickly and easily at the job site from precast segments. It is contemplated that by using this invention smokestacks with heights greater than 200 feet and diameters in excess of 12 feet may be easily erected. With this invention a large size diameter stack would not present a problem, because it is a simple matter to design the stack by increasing the number of segments to increase the diameter. To give an illustration of the size involved, it is contemplated that each of these segments may be in excess of 4 feet thick and 10 feet in arcuate length. However, the stack may be easily erected and the resulting smokestack is structurally stable and can withstand substantial wind loads under normal operating conditions.

BRIEF DESCRIPTION OF THE DRAWINGS

In order that the invention may be clearly understood and readily carried into effect, preferred embodiments will now be described, by way of example only, with reference to the accompanying drawings wherein:

FIG. 1 is an elevational view of a sectional smokestack constructed according to the present invention;

FIG. 2 is a cross-sectional plan view of a smokestack section along line A—A in FIG. 1 with portions omitted for clarity;

DESCRIPTION OF PREFERRED EMBODIMENTS

Figure 3:
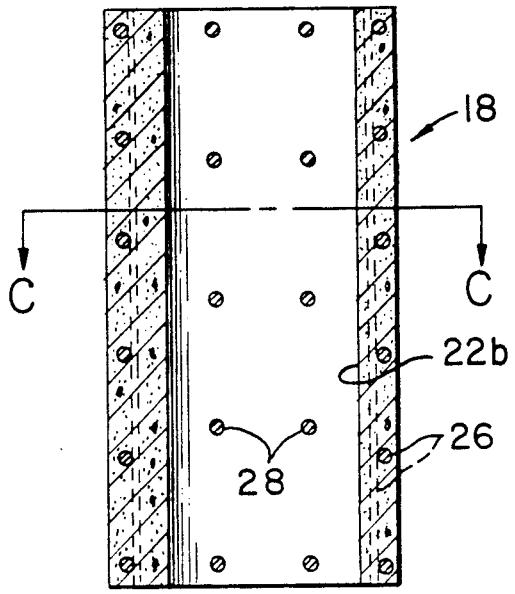
FIG. 3 is an elevational sectional view along line B—B in FIG. 2 of one segment of the smokestack shown in FIG. 1.

A concrete smokestack 10 constructed of precast segments is shown in FIG. 1. This smokestack 10 rests on a foundation 12. A breeching inlet 14 is also shown which directs hot gases and smoke from an incinerator or furnace, for example, to the interior of the smokestack 10.

The smokestack 10 is constructed at the job site in sections 16 as shown in FIGS. 1 and 2. Each of these sections 16 is in turn constructed of precast segments 18 which are assembled at the job site into sections 16 in a manner which will be described.

Figure 5:
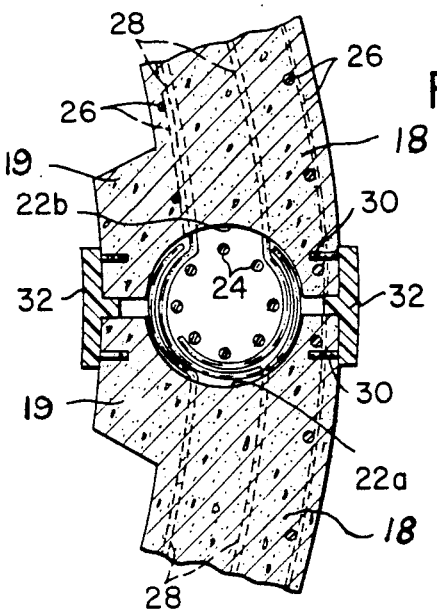
FIG. 5 is FIG. 4 to which has been added the corresponding portion of the adjoining segment and the vertical reinforcing rods and shows the bending of the structural tie rods according to one embodiment of the present invention.
Figure 7:
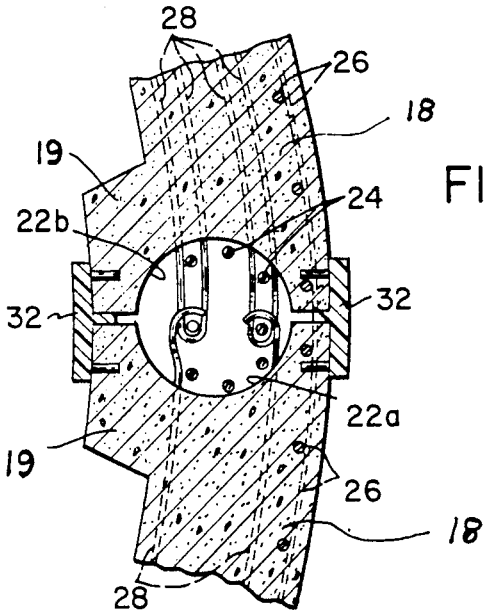
FIG. 7 is FIG. 5 which has been modified according to a second embodiment of the present invention showing the structural tie rods as loops formed when the segments are cast.

The segments 18 when assembled into a section 16 form a flue aperture 20 through which the hot gases or smoke is directed upwardly into the atmosphere. Each of the segments 18 have apertures 22 which run parallel to the flue aperture 20 when the segments 18 are assembled into sections 16. These apertures 22 receive reinforcing rods 24 as shown in FIGS. 5 and 7 when the smokestack 10 is assembled at the job site. When the smokestack is erected the reinforcing rods 24 run from the bottom of the stack to the top of the stack thus tying adjacent sections 16 together. These reinforcing rods 24 enable the concrete smokestack 10 to withstand bending under wind load conditions.

At the lateral ends of each segment 18 as shown in FIG. 2 half apertures 22*a* and 22*b* are formed therein at the time of casting so that when adjoining segments 18 are tied together, as will be described, the half apertures 22*a* and 22*b* form an aperture 22 between adjoining segments.

As shown in FIG. 2, each of the segments 18 are precast having ribs 19 in which apertures 22 are formed. The ribs 19 protrude in a radial direction and extend longitudinally in an axial direction when the smokestack is constructed. The apertures 22 also extend in an axial direction when the smokestack is constructed. When the sections 16 are stacked one above the other, the ribs 19 and apertures 22 of each section 16 are aligned with the next adjacent section 16 below and above so that the ribs 19 and apertures 22 extend axially the length of the smokestack from the bottom of the smokestack to the top of the smokestack. Groups of reinforcing rods 24 are inserted in the apertures 22 and a bonding material such as concrete is poured in the apertures 22 to bond the reinforcing rods 24 to the ribs 19. A smokestack constructed in this manner has essentially "columns" of ribs and reinforcing rods which extend the vertical length of the smokestack. The concrete shell between the ribs 19 comprises a "skin" which provides very little structural support. With this "column" and "skin" approach, a concrete smokestack can be constructed with much less material than would otherwise be the case if conventional solid concrete walls were used. Thus the weight of the smokestack constructed with this technique can be significantly reduced.

A smokestack constructed in this manner has "concentrated reinforcement" extending the entire length thereof. The term "concentrated reinforcement" means that the reinforcing steel rods extending the length of the stack are not distributed more or less evenly throughout the cross-section of the structure, but concentrated at certain places on this cross section. With this construction, the ribs and reinforcing rods bear a major portion of the static forces on the stack, that is the weight of the smokestack, and further a major portion of the dynamic forces on the smokestack, that is the tensile loads resulting from horizontal forces acting upon the smokestack such as caused by wind. Further the reinforcing rods, conventionally being constructed of metal, can bend and stretch under wind loads thus reducing problems of cracking and deterioration of the concrete walls forming the smokestack, which might otherwise occur with solid concrete construction. Also, by using concrete with this "column" and "skin" approach, an almost infinite variety of asthetic designs on the exterior surface can be created since the "skin" bears very little of the static as well as dynamic load of the smokestack.

Figure 4:
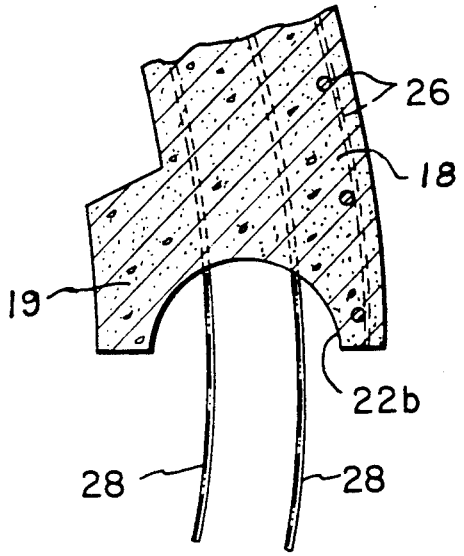
FIG. 4 is a cross-sectional view along line C—C in FIG. 3 before the structural tie rods are bent according to the present invention.

FIG. 3 is an elevational sectional view along line B—B in FIG. 2 and shows an end of a segment 18. FIG. 4 is a plan cross-sectional view of the end of the segment 18 shown in FIG. 3. As shown each of these precast segments 18 includes temperature rebar 26 which is embedded in the concrete at the time the segment 18 is cast. Furthermore, when the segment 18 is cast a plurality of structural tie rods 28 are embedded in the concrete. These structural tie rods 28 extend outwardly from the segment 18 as shown in FIGS. 3 and 4 into the interior of half aperture 22*b*. Although not shown in detail it is intended that the structural tie rods 28 also extend into the interior of half aperture 22*a* at the other end of segment 18 in a similar manner. These structural tie rods 28 are used to tie adjoining segments 18 together in a manner which will now be described.

Prior to assembly of a section 16 horizontal pairs of the structural tie rods 28, which are shown in FIG. 3 and which extend into half aperture 22*b*, are bent in an approximately semicircular manner as shown in FIG. 5. The two semicircles are mirror images of one another and overlap at the ends opposite the segment 18.

At the job site where the smokestack 10 is to be erected a foundation 12 is first formed of concrete. In forming this foundation groups of reinforcing rods 24 are embedded in this concrete at preselected locations and extend upwardly. The location of these groups of reinforcing rods 24 is selected so that each of the groups of reinforcing rods will be aligned with apertures 22 formed in the first section 16 assembled on the foundation 12.

In assemblying a section 16 on foundation 12 a segment 18 is positioned so that one group of reinforcing rods 24 will be received within the interior of the space formed by bending the structural tie rods 28 in semicircles as previously described. Other groups of reinforcing rods 24 will be aligned with the corresponding apertures 22 of the segment 18 and threaded into such apertures. The segment 18 which has been threaded on the reinforcing rods 24 is then lowered until it abuts the foundation. The structural tie rods 28 are then secured to the reinforcing rods 24 with wire (not shown) in a conventional manner.

The next adjoining segment 18 is now ready to be set in place. To avoid interference of the structural tie rods 28 of one segment 18 with the structural tie rods 28 of the adjoining segment 18, the structural tie rods 28 in half aperture 22*b* are bent to overlap the structural tie rods 28 in half aperture 22*a* as shown in FIG. 5. The reinforcing rods 24 are then threaded through the apertures 22 and the segment 18 is lowered until it abuts the foundation. The structural tie rods 28 in half aperture 22*a* are then secured to the reinforcing rods 24 with wire (not shown) in a conventional manner. In a similar manner, additional segments 18 are threaded onto the remaining groups of reinforcing rods 24 until a completed section 16 is formed. At this point concrete is poured into the apertures 22. When the concrete hardens adjoining segments 18 are secured and tied together.

In a similar manner sections adjacent vertically are assembled at the job site to complete the erection of smokestack 10. Preferrably the bending of the structural tie rods 28 into semicircles is staggered vertically as the smokestack is erected. Thus in one section the structural tie rods in half apertures 22*b* are bent in semicircles and then in the next vertically adjacent section the structural tie rods in half apertures 22*a* are bent in semicircles. This sequence is continued as the stack is being erected.

In normal construction of a smokestack 10, the reinforcing rods 24 are brought to the job site in sections.

During to accomodate only a few sections. This is done to minimize threading difficulties. The next few sections are assembled around these reinforcing rods. Additional lengths of the reinforcing rods are then welded or tied to the reinforcing rods in place and the process repeated until the stack is completed. The concrete poured into apertures 22 not only ties adjoining segments 18 together, it also ties adjacent vertical sections 16 together.

Figure 6:
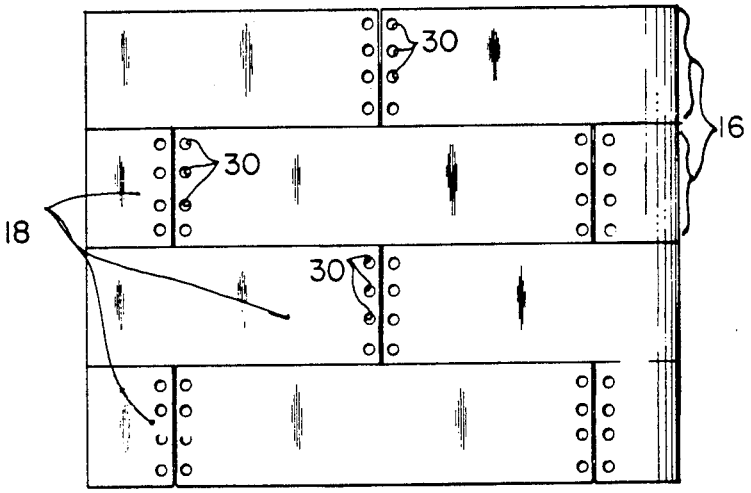
FIG. 6 is an enlarged elevational view of four sections of the smokestack shown in FIG. 1 showing the staggering of the vertical joints between segments.

In constructing a smokestack according to the present invention the vertical joints between adjoining segments 18 are staggered as shown in FIG. 6. The horizontal joints between sections 16 and the vertical joints between adjoining segments 18 are sealed with mortar in a conventional manner. Holes 30 are drilled on either side of the vertical joints both on the outside and the inside surfaces of the smokestack segments and plastic inserts 32 having bosses corresponding to the drilled holes 30 are friction fit over the vertical joints as shown in FIG. 5. These plastic inserts protect the vertical joints from damage after erection of the smokestack.

By assemblying sections 16 at the job site with segments 18 and stacking sections 16 in a "building block" type manner an entire smokestack 10 can be erected quickly and easily. The entire smokestack is structurally held together with reinforcing bars both vertically and circumferentially. With this reinforcement a smokestack constructed according to the present invention is capable of withstanding substantial wind loads under normal operating conditions.

A second embodiment of the present invention is shown in FIG. 7. Here horizontal pairs of structural tie rods 28 as shown in FIG. 3 extending into half aperture **22*b* are bent, at the time the segment is being cast, to form elongate loops as shown in FIG. 7. These elongate loops are threaded over two pairs of reinforcing rods 24 as shown in FIG. 7 when a section 18 is being assembled at the job site. The corresponding horizontal pairs of structural tie rods 28 extending into half aperture 22*a* of an adjoining segment 18 are formed with open hooks which hook reinforcing rods 24 as shown in FIG. 7. The structural tie rods 28 which are formed as hooks are then tied to the reinforcing rods 24 with wire (not shown) in a conventional manner before concrete is poured into aperture 22. As with the first embodiment it is preferred that the loops and hooks of the structural tie rods 28** be staggered vertically as the smokestack is being erected.

Figure 8:
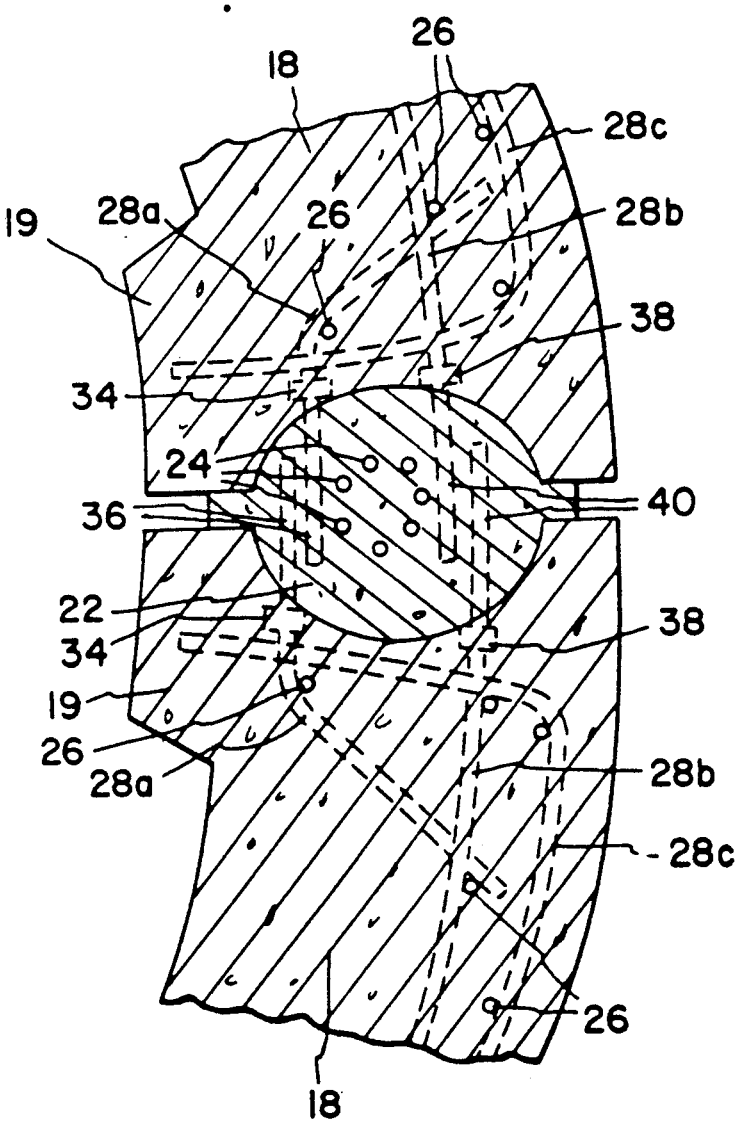
FIG. 8 is FIG. 5 which has been modified according to a third embodiment of the present invention showing the joining of adjacent segments and specifically showing structural tie rods formed in accordance with this embodiment of the present invention.

As shown in FIG. 8, each of the precast segments 18 have been joined end-to-end forming an aperture 22 between the segments. The plurality of vertical reinforcing rods 24 extending longitudinally through aperture 22 are consolidated to form a concentrated reinforcement within aperture 22 that extends from the bottom of the smokestack to the top of the smokestack. A plurality of structural tie rods, **28*a*, 28*b*, and 28*c* are used to tie adjoining segments 18 together, transfer wind loads and heat stress loads to the concentrated reinforcement, and further tie rib 19 to segment 18** in a manner which will now be described.

Figure 9:
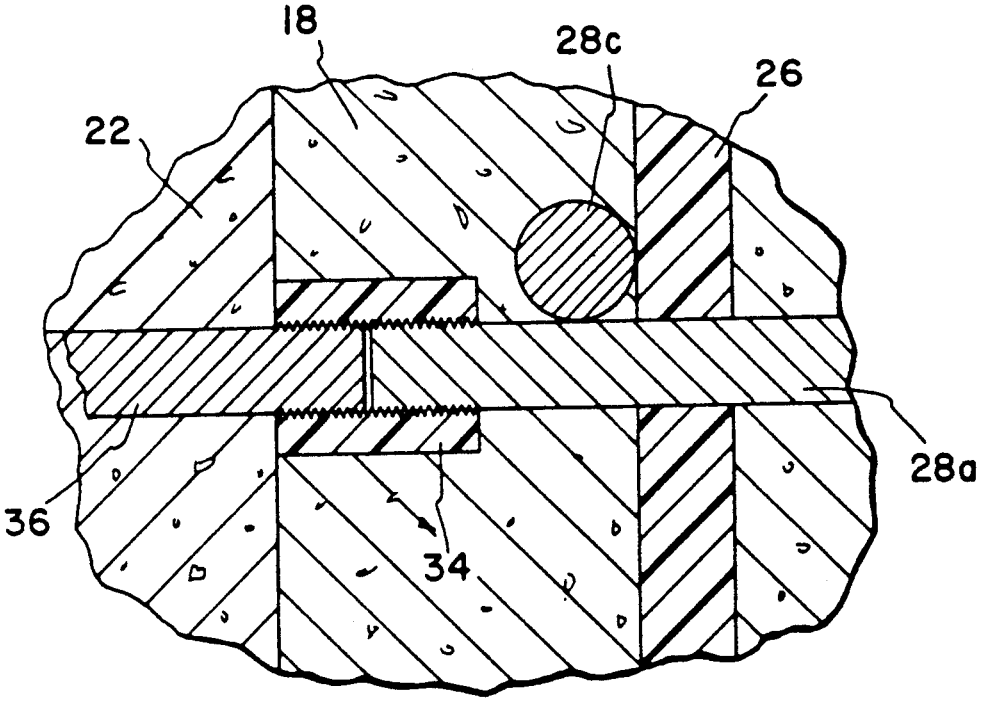
FIG. 9 is a detail cross-sectional view showing the joining of a tie rod and a tie rod extender by a coupler according to the third embodiment of the present invention.

Within segment 18, structural tie rod **28*a* extends from a side of segment 18 opposite the side from which rib member 19 protrudes toward a side of the segment from the rib member protrudes. Structural tie rod 28*a* is bent to be received by a first tie rod coupler 34 which coupler is located within segment 18 and opens into aperture 22. As shown in FIG. 9, a first tie rod extender 36 is threadably received by the opening in first tie rod coupler 34, and as shown in FIG. 8, the first tie rod extender 36 extends inside aperture 22 between the concentrated reinforcement and the side of segment 18 from which rib 19** protrudes.

First tie rod extender 36 is embedded, together with the concentrated reinforcement, in a bonding material filling aperture 22. With this construction, wind loads are transmitted to the concentrated reinforcement. Further, tie rod **28*a*, which extends across segment 18 between opposite sides and through rib 19, further ties rib 19 to segment 18**.

Structural tie rod **28*b* extends laterally within segment 18, through rib member 19 to be received and attached to second tie rod coupler 38. Second tie rod coupler 38 is located within segment 18 adjacent to the boundary with aperture 22 and has one end opening into aperture 22. A second tie rod extender 40 is threadably received in the opening of coupler 34. Tie rod extender 40 extends inside aperture 22 on the side of the concentrated reinforcement opposite the side where first tie rod extender 36 is positioned. Both tie rod extenders 36 and 40, and the concentrated reinforcement are embedded in bonding material in aperture 22**.

With this construction wind loads acting on the smokestack are transmitted to the concentrated reinforcement means.

Further with this construction the concentrated reinforcement is restricted from radial movement relative to rib 19 adding to the structural stability of the "column" and "skin" construction of the smokestack.

In addition second tie rod **28*b*** functions to transmit to the concentrated reinforcement heat stress loads caused by the expansion and contraction of the smokestack when being used.

As best seen in FIG. 8, the structural tie rods **28*a*, 28*b*, and 28*c* are positioned with cross-over points to form a triangularly-shaped brace on either side of aperture 22. Temperature rebar 26 is welded at the cross-over point to add structural integrity. These triangularly-shaped braces further resist lateral movement of the concentrated reinforcement embedded in a bonding material within aperture 22**.

As wind is directed at a smokestack, forces will occur such that one side will be in tension, the opposite side will be in compression. Since tie rod **28*a*, 28*b*, and 28*c* can resist bending forces much better than the concrete in segment 18 or the bonding material in aperture 22, a joint is formed in this embodiment to transfer wind loads from segment 18 to the concentrated reinforcement using structural tie rods positioned laterally and radially on opposite sides of the concentrated reinforcement to resist both radial and lateral forces directed at the smokestack. The structural tie rods are positioned within segment 18** to transmit heat stress loads caused by hot gasses in the flue to the concentrated reinforcement located between adjoining segments of the section.

There are other configurations of the structural tie rods which may be used to tie adjoining segments 18 together. For example, these tie rods could simply be left straight and wire used to tie the tie rods to the reinforcing rods 24. All such other configurations for the structural tie rods 28 are intended to be within the scope of the present invention.

The number of segments 18 and shape of these segments as shown in FIG. 2 are illustrated by way of example only. The number and shape of these segments may vary according to the over-all size and configuration of the completed smokestack.

While the fundamental novel features of the invention have been shown and described, it should be understood that various substitutions, modifications and variations may be made by those skilled in the art without departing from the spirit of scope of the invention. Accordingly, all such modifications and variations are included within the scope of the invention as defined by the following claims:

I claim:

1. In a tall industrial smokestack having a bottom and a top, the smokestack constructed of sections axially stacked one upon the other to form a flue, the improvement comprising:

multiple laterally adjoining segments assembled to form a section of the smokestack;

each section having rib members being integrally formed on the segments which rib members protrude in a radial direction and extend longitudinally in an axial direction of the completed smokestack;

each rib member further having an aperture formed therein for receiving concentrated reinforcement which extend longitudinally in an axial direction of the completed smokestack;

each segment having a first structural tie member means which extends from a side of the segment opposite the side from which the rib member protrudes toward the side from which the rib member protrudes and then being bent to extend into the aperture and then positioned to extend within the aperture in a substantially straight line toward the laterally adjoining segment and on the side of the concentrated reinforcement adjacent the side from which the rib member protrudes for transferring wind loads on the segment to the concentrated reinforcement and for structurally tying the rib member to the section;

each rib member and corresponding aperture of each section being aligned with a rib member and aperture of a section next above and below each section so that the ribs and concentrated reinforcement received by the apertures in the completed smokestack will extend from the bottom of the smokestack to the top of the smokestack;

the apertures in the completed smokestack being filled with bonding material for bonding the concentrated reinforcement to the ribs of the sections whereby the ribs, the first structural tie members reinforcement means, and the concentrated reinforcement are bonded together to form a structural column extending from the bottom of the smokestack to the top of the smokestack.

2. A tall industrial smokestack according to claim 1 further including a second structural tie member means extending from a segment into the aperture on the side of the concentrated reinforcement opposite the first structural tie member for transferring wind loads on the segment to the concentrated reinforcement and for transferring heat stress loads from the flue to the concentrated reinforcement.

3. A tall industrial smokestack according to claim 2 further including a third structural tie member means extending along a side of the segment opposite the side from which the rib member protrudes and into the rib member along a side of the aperture for tying the rib member to the section.

4. In a tall industrial smokestack having a bottom and a top, the smokestack constructed of sections axially stacked one upon the other to form a flue, the improvement comprising:

multiple laterally adjoining segments assembled to form a section of the smokestack;

each section having rib members being integrally formed on the segments which rib members protrude in a radial direction and extend longitudinally in an axial direction of the completed smokestack;

each rib member further having an aperture formed therein for receiving concentrated reinforcement which extend longitudinally in an axial direction of the completed smokestack;

each segment having a first structural tie member means for transferring wind loads on the segment to the concentrated reinforcement and for structurally tying the rib member to the section;

the structural tie member means including a first tie rod coupler means for joining a first tie rod and a first tie rod extender, the first tie rod extending from a side of the segment opposite the side from which the rib member protrudes toward the side from which the rib member protrudes to the first tie rod coupler means, and the first tie rod extender extending from the first coupler means inside the aperture in a substantially straight line toward the laterally adjoining segment and along a side of the concentrated reinforcement adjacent the side from which the rib member protrudes;

each rib member and corresponding aperture of each section being aligned with a rib member and aperture of a section next above and below each section so that the ribs and concentrated reinforcement received by the apertures in the completed smokestack will extend from the bottom of the smokestack to the top of the smokestack;

the apertures in the completed smokestack being filled with bonding material for bonding the concentrated reinforcement to the ribs of the sections whereby the ribs, the first structural tie members reinforcement means, and the concentrated reinforcement are bonded together to form a structural column extending from the bottom of the smokestack to the top of the smokestack.

5. A tall industrial smokestack according to claim 4 wherein the first tie rod coupler means includes means for threadably receiving the first tie rod extender.

6. A tall industrial smokestack according to claim 4 including a second structural tie member means for transferring wind loads on the segment to the concentrated reinforcement and for transferring heat stress loads from the flue to the concentrated reinforcement;

the second structural tie member means including a second tie rod coupler means for joining a second tie rod and a second tie rod extender, the second tie rod being embedded within the segment and extending laterally through the segment to the second tie rod coupler means, and the second tie rod extender extending from the second tie rod coupler means inside the aperture on the side of the concentrated reinforcement opposite the side where the first structural tie member is positioned.

7. A tall industrial smokestack according to claim 6 wherein the second tie rod coupler means includes means for threadably receiving the second tie rod extender.

8. A tall industrial smokestack according to claim 6 including a third structural tie member extending within and across the rib beside the aperture, the first, second, and third structural tie members being positioned and tied together to form traingularly-shaped bracing within the rib beside the aperture.

* * * * *